US006341569B2

(12) United States Patent
Furuichi et al.

(10) Patent No.: US 6,341,569 B2
(45) Date of Patent: Jan. 29, 2002

(54) SEWING MACHINE HAVING MEANS FOR ESTIMATING MASS OF SEWING MATERIAL

(75) Inventors: Mikio Furuichi, Kariya; Hideki Kuzuya, Nagoya; Akira Mineno, Kariya, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/803,934

(22) Filed: Mar. 13, 2001

(30) Foreign Application Priority Data

Mar. 22, 2000 (JP) ..... 12-080468
Dec. 22, 2000 (JP) ..... 12-390722

(51) Int. Cl.[7] ..... D05B 21/00
(52) U.S. Cl. ..... 112/475.02; 112/102.5; 112/475.19
(58) Field of Search ..... 112/475.19, 475.01, 112/475.02, 470.06, 102.5; 700/138, 136

(56) References Cited

U.S. PATENT DOCUMENTS 5,372,078 A * 12/1994 Hoshina et al. ..... 112/102.5 X
5,732,641 A * 3/1998 Kawasaki ..... 12/470.07

* cited by examiner

*Primary Examiner*—Peter Nerbun
(74) *Attorney, Agent, or Firm*—Burns, Doane, Swecker & Mathis, LLP

(57) ABSTRACT

A sewing machine includes a movable holder portion which holds a material to be sewn, a holder drive portion which transfers the holder portion during sewing, a needle drive portion which drives a sewing needle to sew, and a controller which intelligently regulates the holder drive portion and the needle drive portion. The controller includes a) an initial motion device which initially transfers the material to be sewn before sewing or during an initial stage of sewing, and b) an estimating device which finds the mass of the material to be sewn depending on a physical value such as at least one of a moving velocity of the material to be sewn at a predetermined period of time and a moving distance of the material within the amount of the predetermined period of time.

20 Claims, 12 Drawing Sheets

Fig. 7

| Less than or equal to S1 | Operation mode 1 |
|---|---|
| S1 ~ S2 | Operation mode 2 |
| S2 ~ S3 | Operation mode 3 |
| S3 ~ S4 | Operation mode 4 |

Fig. 8

| | Frame moving distance | 1mm | 2mm | 3mm | --- |
|---|---|---|---|---|---|
| Operation mode 1 | Revolution number of top shaft | W11 | W12 | W13 | --- |
| | Frame moving velocity | T11 | T12 | T13 | --- |
| Operation mode 2 | Revolution number of top shaft | W21 | W22 | W23 | --- |
| | Frame moving velocity | T21 | T22 | T23 | --- |
| Operation mode 3 | Revolution number of top shaft | W31 | W32 | W33 | --- |
| | Frame moving velocity | T31 | T32 | T33 | --- |

SEWING MACHINE HAVING MEANS FOR ESTIMATING MASS OF SEWING MATERIAL

This application is based on and claims priority under 35 U.S.C. § 119 with respect to Japanese Application No. 2000-080468 filed Mar. 22, 2000 and Japanese Application No. 2000-390722 filed Dec. 22, 2000, the entire contents of both applications are incorporated herein by reference.

BACK GROUND OF THE INVENTION

1. Field of the invention

This invention relates to a sewing machine.

2. Description of related arts

An embroidery sewing machine, as an example of a conventional sewing machine, will be described as follows: An embroidery sewing machine comprises a) a frame holder holding an embroidering frame to restrain the cloth to be embroidered, b) an electric motor transferring the frame holder during embroidering, c) a needle driver for driving a sewing needle, and d) a controller for intelligently regulating the electric motor and the needle driver. Recently, an improved embroidery sewing machine works more accurately. The mass of the cloth, restrained on the embroidering frame, is varied. Furthermore, it is possible to attach a variety of embroidering frames, having different masses, to the sewing machine. Thus the various masses of the cloth and the various masses of the embroidering frame have a large influence on the sewing accuracy of the embroidery sewing machine. If the masses of the cloth and the embroidering frame are large, a fast embroidering speed vibrates the embroidery sewing machine and sags the embroidering frame because of a larger inertia thereof.

Thus improvement in embroidering accuracy of the embroidery sewing machine is limited.

To overcome the above problem, a conventional embroidery sewing machine comprises a setting means enabling selection of either a small mass material embroidering mode or a large mass material embroidering mode. The small mass material embroidering mode is one embroidering mode for cloth having a small mass. The large mass material embroidering mode is the other embroidering mode for cloth having a large mass. A person operating the embroidery sewing machine first decides whether the cloth to be embroidered has a large mass or not, and second inputs either the small mass embroidering mode or the large mass embroidering mode into the setting means for embroidering accuracy. If the cloth to be embroidered has a small mass, then the controller regulates the sewing machine to embroider at a rapid speed depending on the embroidering mode input by the person. If the cloth to be embroidered has a large mass, then the controller regulates the sewing machine to embroider at a slow speed. However, it is impossible for the person to accurately select whether the cloth has a large mass or not based upon eyesight. Both a material of the cloth (i.e. soft or stiff) and a condition for restraining the cloth on the embroidering frame (i.e. the cloth having a freely swingable portion extending off the embroidering frame) influence an inertia of the embroidering frame. Accordingly, if the person confirms the mass of the cloth only by eyesight, and determines whether the cloth is embroidered in the larger mass embroidering mode or the small mass embroidering mode, the selection of embroidering modes is not accurately suitable to the inertia of the embroidering frame, thus limiting any improvement in embroidering accuracy.

SUMMARY OF THE INVENTION

Accordingly, it is an object of the present invention to provide an improved sewing machine.

It is another object of the present invention to provide an improved sewing machine which obviates the above conventional drawbacks.

It is a further object of the present invention to provide a sewing machine which can estimate the mass of the material to be sewn. The sewing machine can accurately move the material, thereby providing a suitable sewing condition according to the mass of the material, and thereby obtaining sufficient embroidering accuracy.

In accordance with a first aspect of this invention, a sewing machine comprises a movable holder portion for holding a material to be sewn, a holder drive portion for moving the holder portion during sewing of the material, a needle drive portion for driving a sewing needle to sew, and a controller for regulating the holder drive portion and the needle drive portion. The controller includes an initial motion means for moving the material to be sewn before sewing or in an initial stage of sewing, and an estimating means for estimating a mass of the material depending on a physical value such as a moving speed of the material or a moving distance of the material for a predetermined period of time.

In accordance with a second aspect of this invention, the sewing machine further comprises an estimated mass adaptive control means for automatically adjusting a control mode based on the estimated mass of the material by the estimating means.

In accordance with a third aspect of this invention, the sewing machine determines the physical value based upon a driving speed of an initial movement of the movable holder portion holding the material or a driving distance of the holder drive portion for the predetermined period of time.

Thus, the present invention has the following advantages. In the sewing machine of this invention, before sewing or at the initial stage of sewing, the holder portion holding the material to be sewn is initially moved by the initial motion means. In the initial moving of the holder portion, the estimating means estimates the mass of the material to be sewn depending on the physical value of at least one of the moving velocity of the material and the moving distance of the material. Under the same conditions as the holder portion and the holder drive portion before the initial moving thereof, when the material is moved slowly during the initial moving, the estimating means determines the mass of the material to be large. When the material is moved rapidly during the initial moving, the estimating means determines the mass of the material to be small.

Also, under the same conditions of the holder portion end the holder drive portion before the initial moving thereof, when the moving distance within a predetermined amount of time is small, the estimating means determines the mass of the material to be large. When the moving distance within the predetermined amount of time is large, the estimating means determines the mass of the material to be small. Since mass generally corresponds to weight, the weight of the material is automatically determined based upon the mass of the material.

The sewing machine of this invention can automatically adjust a sewing condition thereof depending on the mass of the material estimated by the estimating means.

Thus accuracy of sewing, such as embroidering, can be kept independently of the mass of the material on the holder portion.

The sewing machine of this invention comprises the estimated mass adoptive control means which automatically determines the optimal control mode for regulating the holder drive portion. The estimated mass adoptive control means determines the optimal control mode depending on the mass of the material estimated by the estimating means. The estimated mass adoptive control means finds the optimal control mode for the holder drive portion and sets a constant for regulating the holder drive portion. The constant is optimally set (for accurately positioning the holder portion within a short response time) due to being precisely analyzed. When the mass of the material is large, the holder drive portion is driven slowly by the control mode set by the estimated mass adoptive control means. When the mass of the material is small, the holder drive portion is driven rapidly.

BRIEF DESCRIPTION OF THE DRAWINGS

These and other objects of the invention will become more apparent from the following embodiment of the intention with reference to the attached drawings in which:

FIG. 7 shows a map 1 representing a suitable control mode for an estimated mass of the material;

FIG. 8 shows a map 2 representing embroidery data which is suitable to the control mode;

DESCRIPTION OF THE PREFERRED EMBODIMENT

A sewing machine comprises a) a movable frame holder which supports an embroidering frame restraining a material to be sewn, b) a frame holder driver which transfers the frame holder, c) a needle driver which drives a sewing needle, and d) a controller which intelligently regulates the frame holder driver and the needle driver. During a sewing operation without the frame, such as when an embroidering frame is attached to the frame holder, the mass of the material to be sewn is generally directly equal to the mass of the cloth to be sewn. During another sewing operation when the frame such as the embroidering frame is on the frame holder, the material mass is equal to the mass of the cloth to be restrained by the frame holder, or is sometimes equal to the sum of the mass of the cloth and the mass of the frame holder. If accessories such as buttons are attached to the material, the mass of the material means the mass of the cloth together with the accessory.

The controller comprises an initial motion means, an estimating means, and an estimated mass adaptive control means. The initial motion means moves the frame holder with the material during an initial stage of the sewing operation. The estimating means estimates the mass of the material depending on a physical value which is at least one of a velocity of the material during the initial stage of the sewing operation and a moving distance of the material for a predetermined period of time. The estimated mass adaptive control means determines a control mode for regulating the frame holder driver depending on the material mass estimated by the estimating means. The initial motion means, the estimating means and the estimated mass adaptive control means are formed by either a set of a micro computer and a program or an electrical circuit. As the physical value for the moving speed and the moving distance of the material for the predetermined period of time, at least one of a driving speed of the frame holder driver during the initial stage of the sewing operation and a driving distance per unit time of the frame holder driver is suitable. When the frame holder driver is dominantly driven by an electric motor, either a driving speed of the electric motor (a rotation velocity of the electric motor) or a driving distance of the electric motor (a rotation amount of the electric motor) is suitable. In addition, the sewing machine of this invention further comprises a display means for showing the material mass which is estimated by the estimating means. In this case, a person operating the sewing machine can visually confirm the estimated material mass. The person can also manipulate the parameters to adjust a sewing operation mode and a sewing condition.

Figure 12:
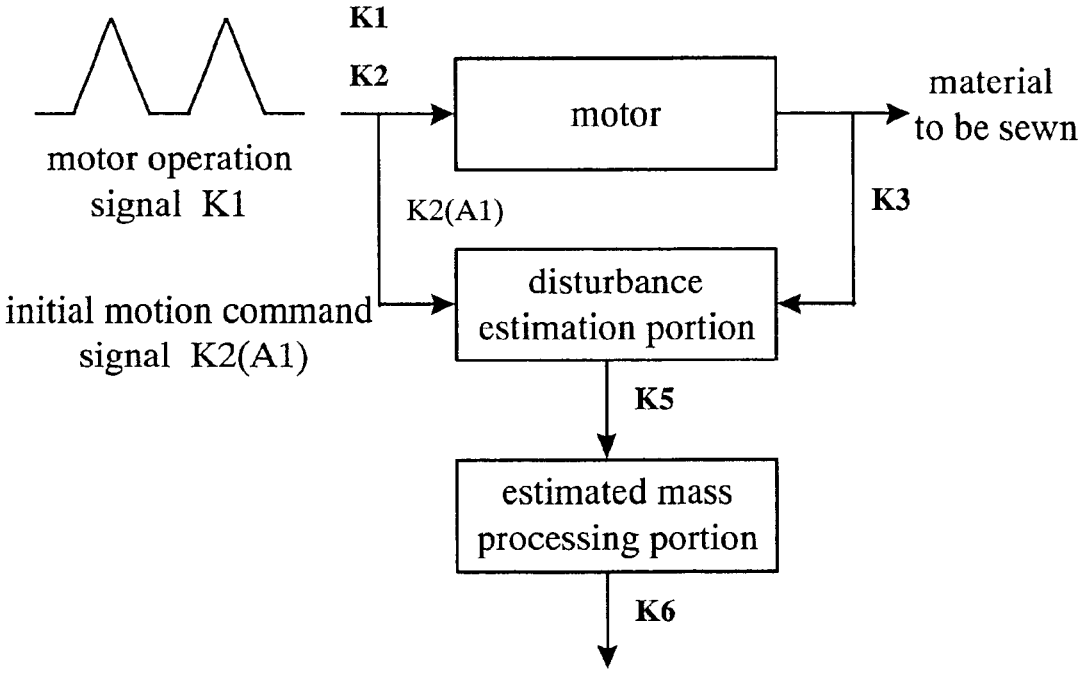
FIGS. 12(A) and 12(B) show a main flow chart diagram for an X frame drive controller which processes the embroidery sewing machine of the embodiment.
Figure 12:
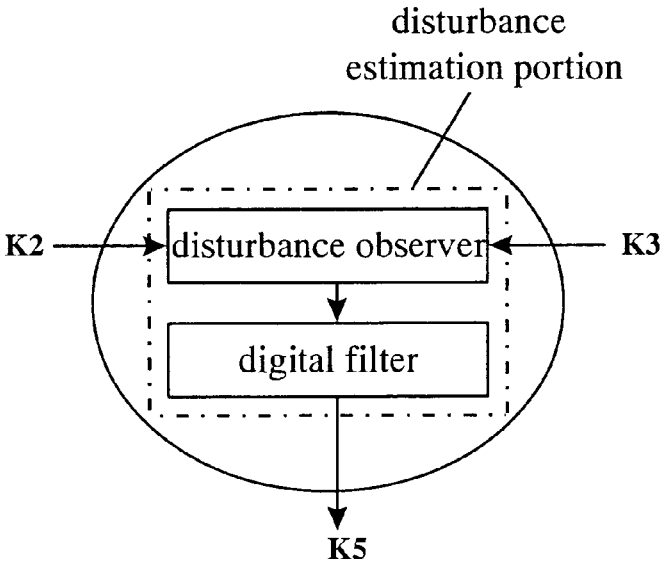

FIG. 12(A) shows a typical main block diagram which is related to the controller of an embodiment of this invention. The sewing machine shown in FIG. 12(A) comprises the electric motor as the frame holder driver which moves the frame holder holding the material to be sewn. During the sewing operation, a motor operation signal K1 is sent to the electric motor, whereby the frame holder with the material is moved. The needle driver is also moved together with the frame holder, then the sewing operation such as embroidering is performed. An initial motion means sends an initial motion command signal K2 to the electric motor before the sewing operation or during the initial stage of the sewing operation, whereby the frame holder is previously or initially moved. In the above process, a motor velocity signal K3 and the initial motion command signal K2 are input to a disturbance estimation portion. The motor velocity signal K3 is received by a motor velocity detection means (.i.e. an encoder). The disturbance estimation portion shown in FIG. 12(B) comprises a) a disturbance observer estimating a disturbance of the electric motor depending on the initial motion command signal K2 and the motor velocity signal K3, and b) a digital filter sampling a signal having a desirable frequency. The motor velocity signal K3 corresponds to the physical value of the driving velocity of the frame holder driver. The disturbance estimation portion estimates a disturbance of the electric motor depending on the motor velocity signal K3 and the initial motion command signal K2, thereby estimating a change of the material mass. The disturbance estimation portion sends an estimated disturbance signal K5 to an estimated mass processing portion. The estimated mass processing portion transforms the estimated disturbance signal K5 into the physical value corresponding to mass, thereby outputting an estimated disturbance signal K6. When the material mass is varied, the, estimated disturbance signal K5 is varied resulting from the material mass, and then the estimated disturbance signal K6 is varied. In the above system, the disturbance estimation portion and the estimated mass processing portion are formed by programs operating a CPU.

The embodiment of this invention will be described as follows referring to the attached drawings.

Figure 1:
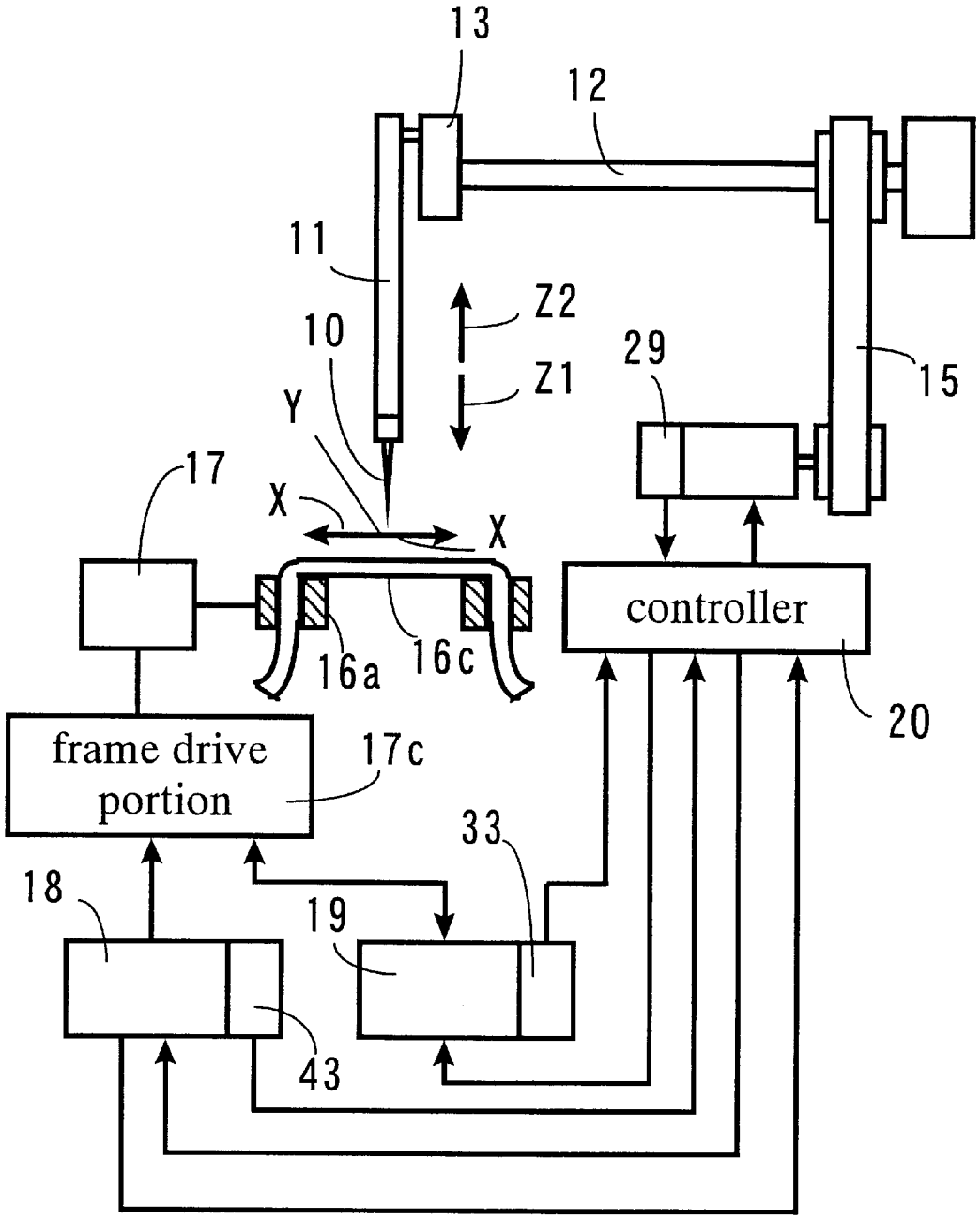
FIG. 1 shows a block diagram of a sewing machine of an embodiment of this invention having an embroidery function.

FIG. 1 shows a block diagram of the embroidery sewing machine. An X-axis direction indicates one direction of a horizontal plane of the embroidery sewing machine. A Y-axis direction indicates the other direction of the horizontal plane. A Z-axis direction (a Z1 direction and a Z2 direction) indicates a vertical direction of the embroidery sewing machine. As shown in FIG. 1, the embroidery sewing machine comprises a needle bar 11 holding a sewing needle 10. The needle bar 11 is swingable movable in the Z-axis direction (a Z1 direction and a Z2 direction). A top shaft 12 is rotatably provided at an upper portion of the embroidery sewing machine. A cam system 13 is disposed between the top shaft 12 and the needle bar 11. The cam system 13 transforms the rotation of the top shaft 12 into the vertical reciprocating motion of the needle bar 11. A top shaft motor 14 as a servomotor, rotates the top shaft 12. A drive belt 15 transmits a driving force of the top shaft motor 14 to the top shaft 12. A holder 17 is detachably holding the material 16 to be sewn (the material of this embodiment includes an embroidering frame 16*a* and a cloth 16*c* detachably attached to the embroidering frame 16*a*). A frame drive system 17*c* moves the holder 17 in the X-axis direction and in the Y-axis direction. An X-motor 18, as a servomotor, transfers the holder 17 with the material 16 in the X-axis direction via the frame drive system 17*c*. A Y-motor 19, as another servomotor, transfers the holder 17 with the material 16 in the Y-axis direction via the frame drive systems 17*c*. A controller 20 intelligently regulates the top shaft motor 14, the X-motor 18 and the Y-motor 19. Since the top shaft motor 14 is a driver activating the needle 10, the top shaft motor 14 corresponds to a needle drive portion. Since both the X-motor 18 and the Y-motor 19 are actuators, the motors transfer the holder 17 holding the material 16. Reference number 29 is a first motor position/velocity measuring portion which will be further described below.

Figure 2:
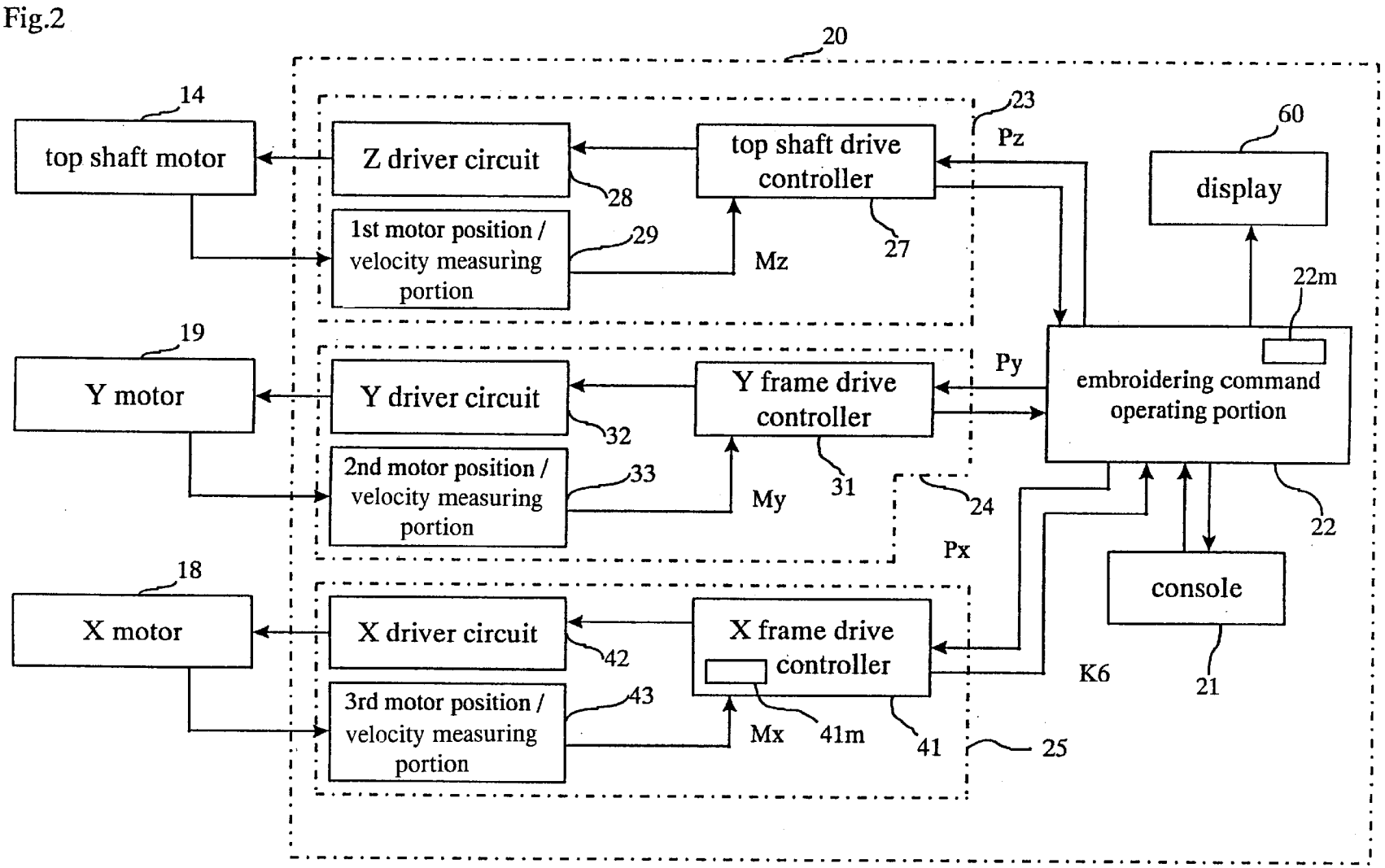
FIG. 2 shows a block diagram of a controller of the sewing machine of the embodiment.

FIG. 2 shows a block diagram of the controller 20. The controller 20 comprises a) a console 21 which can be manipulated by a user, b) an embroidering command operator 22 which includes a main CPU and a memory 22m, c) a top shaft controller 23 which operates the top shaft 12, d) a Y controller 24 which operates the travel amount of the frame holder 17 in the Y-axis direction, and e) an X controller 25 which operates the travel amount of the frame holder 17 in the X-axis direction. The embroidering command operation 22 outputs commands Pz, Py and Px to the top shaft controller 23, the Y controller 24 and the X controller 25, respectively. As shown in FIG. 2, the top shaft controller 23 comprises a top shaft drive controller 27, a Z driver circuit 28 and a first motor position/velocity measuring portion 29. As shown in FIG. 2, the top shaft drive controller 27 includes a first auxiliary CPU operated by the command Pz from the console 21. The first motor position/velocity measuring portion 29 detects the rotation velocity and the motor position of the top shaft motor 14, and sends a signal Mz as a first feedback signal to the top shaft drive controller 27. The Y controller 24 comprises a Y frame drive controller 31, a Y driver circuit 32 and a second motor position/velocity measuring portion 33. The Y frame drive controller 31 includes a second CPU operated by the command Py from the console 21. The second motor position/velocity measuring portion 33 detects the rotation velocity and the motor position of the Y motor 19, and sends a signal My as a second feedback signal to the Y frame drive controller 31. The X controller 25 comprises an X frame drive controller 41, an X driver circuit 42 and a third motor position/velocity measuring portion 43. The X frame drive controller 41 includes a third auxiliary CPU operated by the command Px from the console 21. The third motor position/velocity measuring portion 43 detects the rotation velocity and the motor position of the X motor 18, and sends a signal Mz as a third feedback signal to the X frame drive controller 41. The first motor position/velocity measuring portion 29 is formed of a first increment encoder attached to the top shift motor 14. The second motor position/velocity measuring portion 33 is formed of a second increment encoder attached to the Y motor 19. The third motor position/velocity measuring portion 43 is formed of a third increment encoder attached to the X motor 18. The X frame drive controller 41 comprises the memory 41m into which a program, corresponding to both the disturbance estimation portion and the estimated mass processing portion (as shown FIG. 12), is loaded. Thus, the X frame drive controller 41 has a function of assembling functions of the disturbance estimation portion and the estimated mass processing portion. The disturbance estimation portion is formed of the program including a) the disturbance observer which estimates the disturbance amount of the electric motor and b) the digital filter which samples the signal having a predetermined frequency. Thus, the X frame drive controller 41 sends the estimated disturbance signal K6 to the main CPU of the embroidering command operator 22. The embroidering command operator 22 also comprises a display 60 as shown in FIG. 2. The display 60 shows the estimated mass of the material 16 depending on the signal from the embroidering command operator 22 so that a user can visibly confirm the estimated mass of the material 16.

Prior to the embroidering operation as a typical sewing operation, the user sets the material 16 on the frame holder 17. A thread is inserted into the sewing needle 10 held by the needle bar 11. As the Y motor 19 is driven, then the material 16 with the frame holder 17 are moved in the Y-axis direction. As the X motor 18 is driven, then the material 16 and the frame holder 17 are moved in the X-axis direction. Accordingly, a horizontal motion of the material 16 held by the frame holder 17 is composed of the motions in the X-axis direction and the motions in the Y-axis direction. The top shaft 12 is driven by the top shaft motor 14, thereby bringing the sewing needle 10 into the vertical reciprocating motion, thereby embroidering.

Prior to the above embroidering, the frame holder 17 is initially moved together with the material 16 by the electric motor receiving the command from the controller 20. Then, the mass of the material 16 is estimated by the moving distance thereof during the initial stage of the embroidering.

Figure 3:
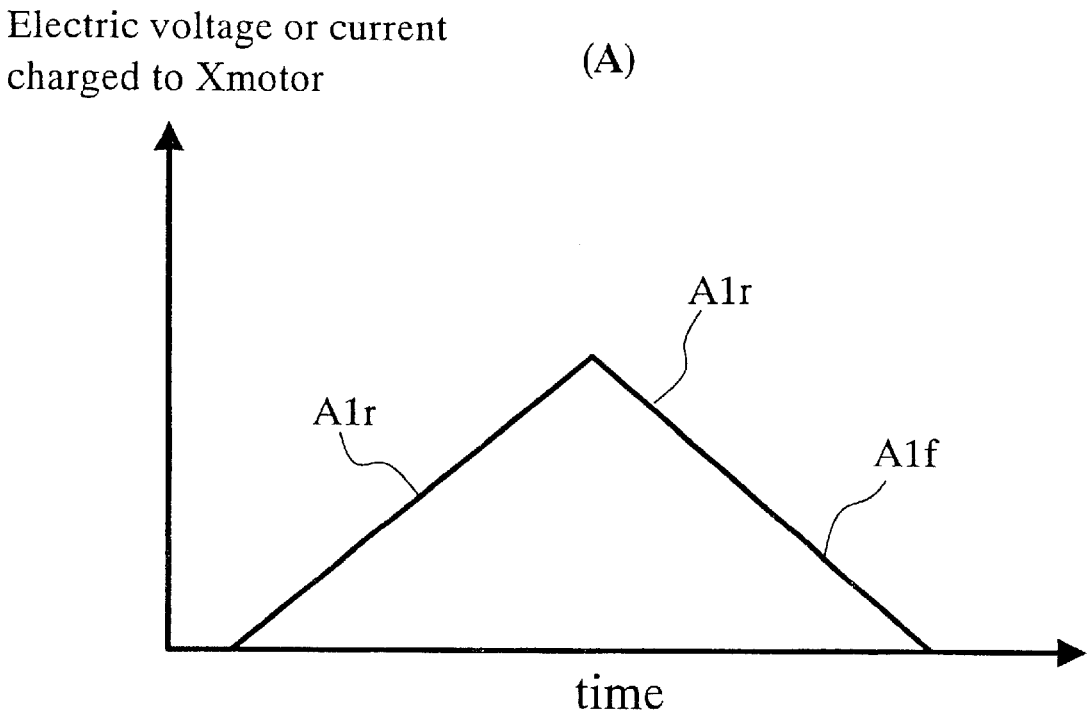
FIGS. 3(A) and 3(B) show waves of initial motion command signals of the embodiment for initially moving a cloth holder holding a material to be embroidered.
Figure 3:
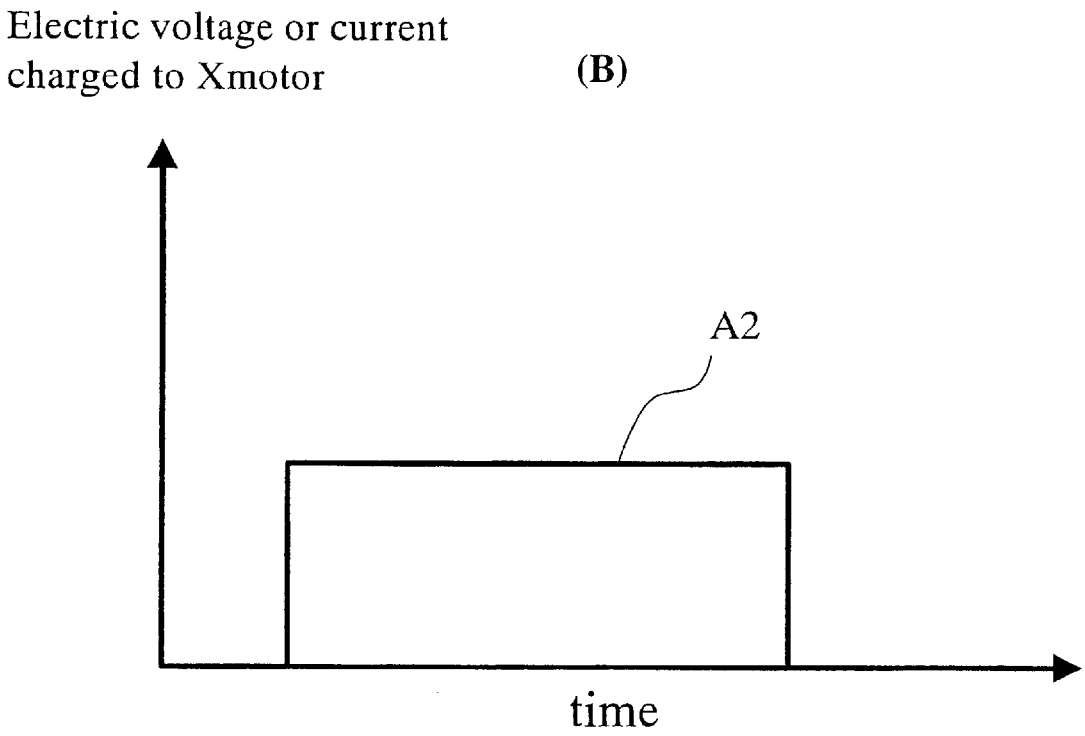

The material mass estimation will be described as follows: In this embodiment, the material mass is estimated by driving the X motor 18. In this material mass estimation, an initial motion command signal A1 having a triangular pulse as shown in FIG. 3(A) is first input to the X motor 18. In FIG. 3, the horizontal axis represents time, and the vertical axis represents an electric voltage or current charged to the X motor 18. The initial motion command signal A1 comprises a first pulse (the electric voltage or current charged to the X motor) which gradually increases depending on time and a second pulse which gradually decreases (the electric voltage or current). Thus the initial motion command signal A1 shows an increment, depending on time, and a decrement. As the initial motion command signal A1 is input to the X motor 18, the material is initially moved in the X-axis direction. Then the motor velocity signal K3 which is monitored by the motor velocity detection means (the third motor position/velocity measuring portion 43) and the initial motion command signal A1 (K2 in FIG. 12) are input to the disturbance observer. Depending on a signal input to X motor and the motor velocity signal K3, the disturbance observer estimates the disturbance of the X motor 18, and sends estimated disturbance signals as results of the motion operation to the digital filter. The digital filter samples an estimated signal having a predetermined frequency. Furthermore, the digital filter calculates a disturbance W1 at a predetermined time, a maximum disturbance W2 within a predetermined amount of time, and a cumulative disturbance W3 within the predetermined amount of time. After that the digital filter selects the most suitable disturbance from the disturbance W1 at a predetermined time, the maximum disturbance W2 within a predetermined amount of time, and the cumulative disturbance W3 within the predetermined amount of time. The estimated mass processing portion, as a program loaded on the X frame drive controller 41, transforms the disturbance into a value corresponding to the mass of the material, and sends the value as the estimated disturbance signal K6 to the embroidering command operator 22. The mass of the material 16 is estimated in the above steps. The weight of the material 16 is automatically found by estimating the mass of the material 16.

Figure 4:
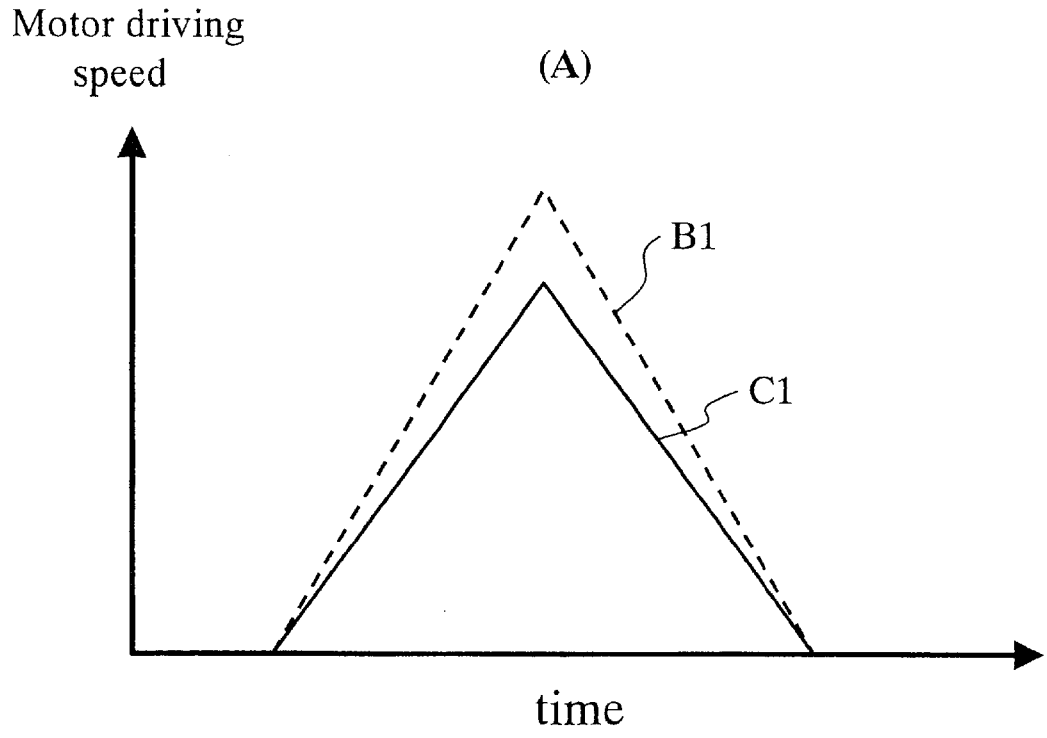
FIGS. 4(A) and 4(B) show waves of rotation velocity of an electric motor of the embodiment initially moving a cloth holder holding the material, these waves output by an encoder.
Figure 4:
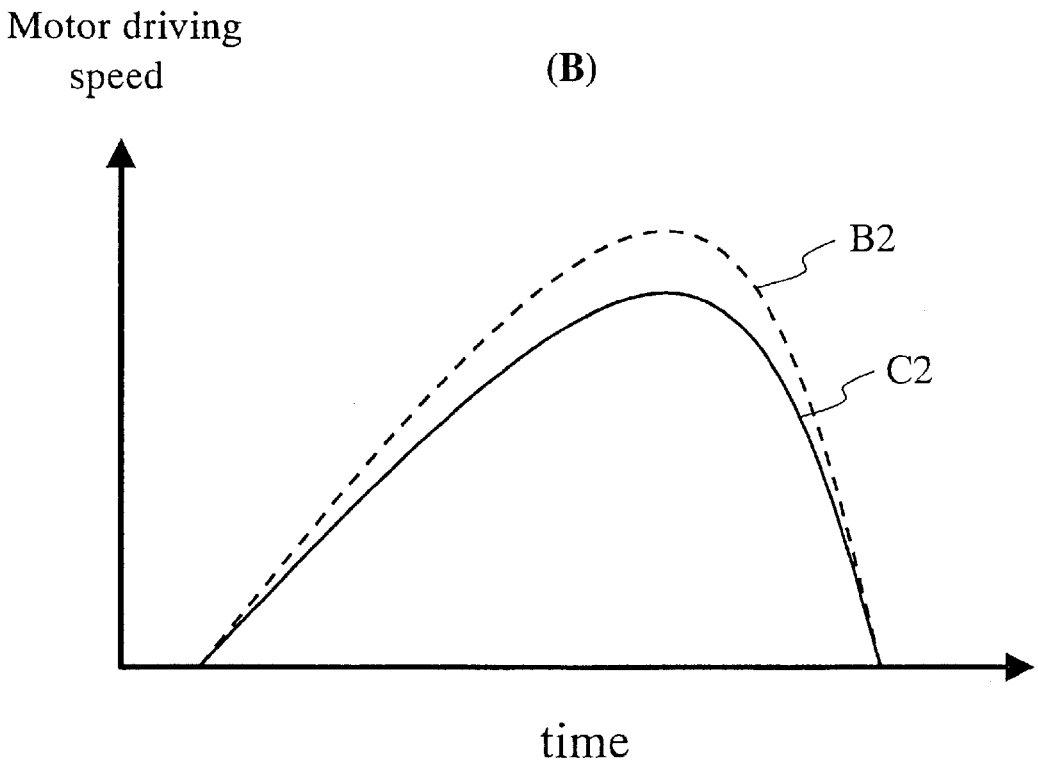

Another example of the material mass estimation will be described as follows: As the initial motion command signal A1 is input to the X motor to be driven, then the material 16 is initially moved by the X motor. If the material mass equals a standard mass, the X motor outputs a standard characteristic pulse B1 as shown in FIG. 4(A). The horizontal axis represents time, the vertical axis represents the rotation velocity of the X motor in FIG. 4(A). If the material mass differs from the standard mass, the X motor outputs a signal characteristic pulse C1 differing from the standard characteristic pulse B1. Even though the same initial motion command signal A1 is input to the X motor, when the material mass is larger than the standard mass, the, rotation velocity of the X motor falls. When the material mass is smaller than the standard mass, the rotation velocity of the X motor is raised.

Figure 5:
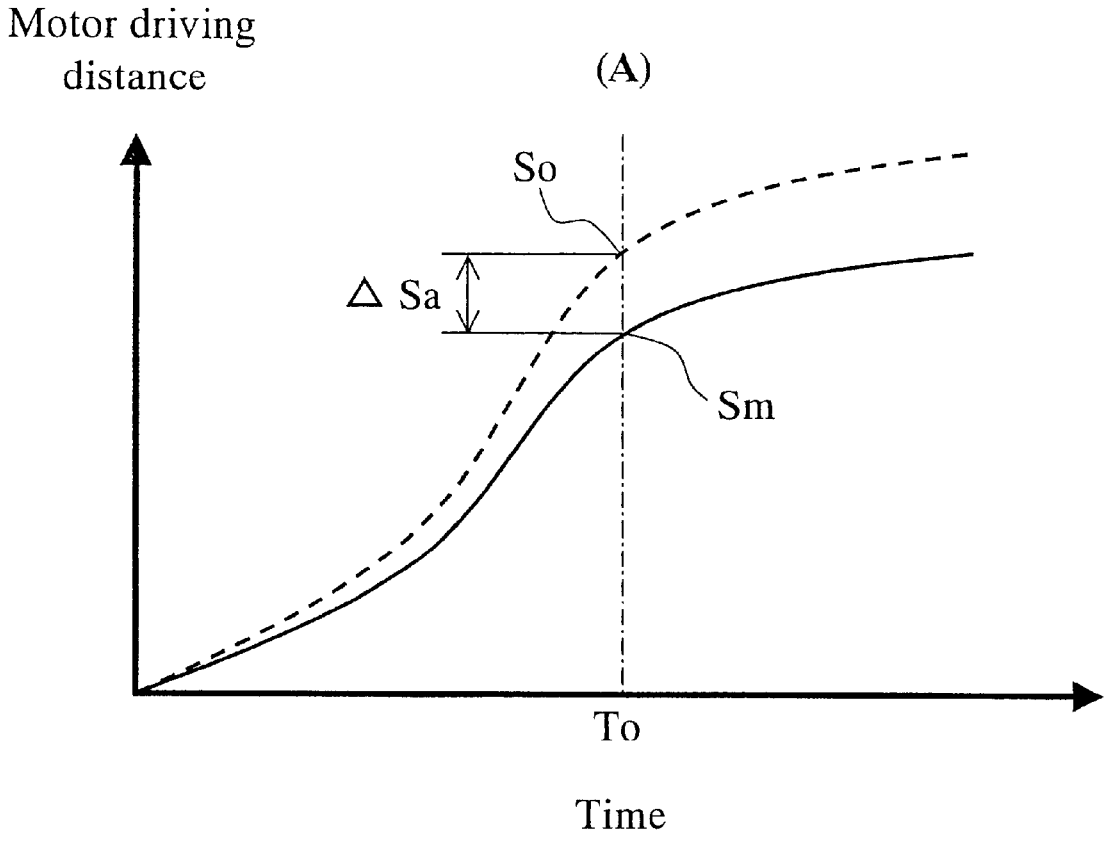
FIG. 5 shows a graph conceptually representing a measured rotation amount and a standard rotation amount of the electric motor of the embodiment initially transferring the cloth holder holding the material.

The embroidering command operator 22 actually measures a motor position Sm (measured motor position Sm) of the X motor 18 at the predetermined time TO (FIG. 5) depending on a measurement signal Mx. The measurement signal Mx is sent from the third motor position/velocity measuring portion 43 (the third increment encoder). The above motor position is defined as a position of a rotor of the X motor 18. The motor position of the X motor 18 relates to a driving distance of the X motor 18. The measurement signal Mx corresponds to a physical value such as the driving distance of the motor 18. A standard motor position S0 within the predetermined amount of time T0 of the X motor 18 is previously stored in either the memory 41 m of the X frame drive controller 41 or the memory 21 m of the embroidering command operator 22. The standard motor position S0 is defined as the motor position of the X motor 18 when the standard mass is moved by the X motor 18 upon receiving the initial motion command signal A1. The embroidering command operator 22 compares the measured motor position Sm and the standard motor position S0 in order to calculate a deviation of rotation amount ΔSa, thereby finding the estimated mass of the material 16 by using a predetermined formula and its variable the deviation ΔSa. The deviation ΔSa is related to the weight of the material. Thus, in this embodiment, the mass of the material 16 is estimated via the weight of the material 16. The weight of the material 16 is automatically found by estimating the mass of the material 16.

Figure 6:
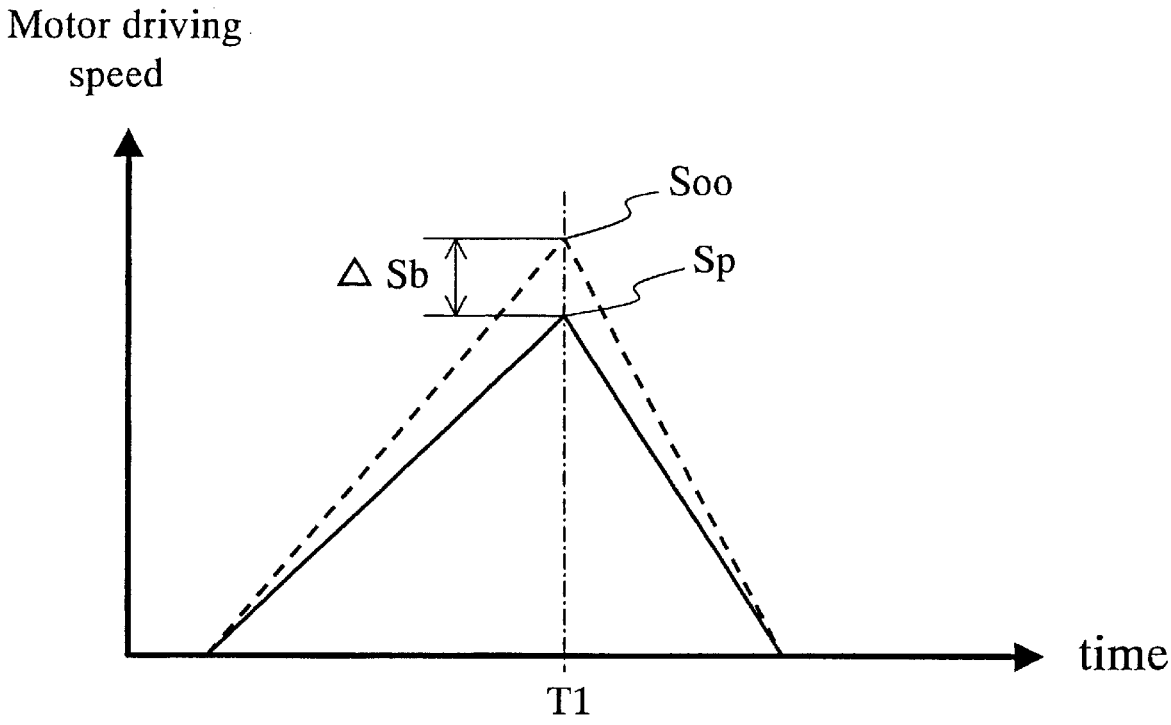
FIG. 6 shows a graph conceptually representing a measured rotation velocity and a standard rotation velocity of the electric motor of the embodiment for initially moving the cloth holder holding the material.

The material mass can also be estimated from the rotation velocity of the X motor 18 instead of the motor position of the X motor 18. The embroidering command operator 22 actually measures a rotation velocity Sp (a measured rotation velocity Sp) of the X motor 18 at a predetermined time T1 (FIG. 6) depending on a motor speed signal which corresponds to a physical value relative to the driving speed of the X motor 18. The motor speed signal is sent from the third motor position/velocity measuring portion 43. A standard rotation velocity S00 of the X motor 18 at the predetermined time T1 is previously stored in either the memory 41 m of the X frame drive controller 41 or the memory 21 m of the embroidering command operator 22. The standard rotation velocity S00 is defined as the rotation velocity of the X motor 18 when the standard mass is moved by the X motor 18 upon receiving the initial motion command signal A1. The embroidering command operator 22 compares the measured rotation velocity Sp and the standard rotation velocity S00 in order to calculate a deviation of rotation velocity ΔSb, thereby finding the estimated mass of the material 16 by using another predetermined formula and its variable the deviation ΔSb. The deviation ΔSb is related to the weight of the material 16. Thus, in this embodiment, the mass of the material 16 is estimated via the weight of the material 16. When the material 16 weight is found by the estimated mass of the material 16, then the X frame drive controller 41 or the embroidering command operator 22 determines the weight of the material by using another predetermined formula depending on the estimated mass of the material 16.

In this embodiment, it is preferable to determine the control mode for regulating the holder drive portion which moves the material 16 depending on a mapping mode. In the mapping mode, map 1 is formed by data representing relationships between an estimated mass and operation modes. A map 2 is formed by data representing relationships among the revolution numbers of the top shaft 12, control modes for controlling moving velocities of an embroidering frame and these above operation modes. The map 1 and the map 2 are previously stored in either the memory 41 m or the memory 22 m as reference data. FIG. 7 conceptually shows a portion of the map 1. According to the map 1, if the estimated mass of the material 16 is less than or equal to S1, the operation mode 1 (corresponding to mass 1) is to be performed. If the estimated mass of the material 16 is greater than S1 and less than or equal to S2, the operation mode 2 (correspondingly to mass 2) is to be performed. If the estimated mass of the material 16 is greater than S2 and less than or equal to S3, the operation mode 3 (corresponding to mass 3) is to be performed. If the estimated mass of the material 16 is greater than S3 and less than or equal to S4, the operation mode 4 (corresponding to mass 4) is to be performed. The relationship between quantities S1, S2, S3, and S4 is: S1<S2<S3<S4.

FIG. 8 conceptually shows a part of the map 2. According to the map 2, in the operation mode 1, the embroidery data are determined as follows: If a moving distance of the embroidering frame per unit time is one millimeter, a first embroidery data determines that the revolution number of the top shaft 12 is W11, and the moving velocity of the embroidering frame is T11. If the moving distance of the embroidering frame per unit time is two millimeters, a second embroidery data determines that the revolution number of the top shaft 12 is W12, and the moving velocity of the embroidering frame is T12. If the moving distance of the embroidering frame per unit time is three millimeters, a third embroidery data determines that the revolution number of the top shaft 12 is W13, and the moving velocity of the embroidering frame is T13. In the same way, in the operation mode 2, the embroidery data are determined as follows: If the moving distance of the embroidering frame per unit time is one millimeter, a fourth embroidery data determines that the revolution number of the top shaft 12 is W21, and the moving velocity of the embroidering frame is T21. The rest of the explanation is omitted.

According to the embroidery data shown in FIGS. 7 and 8, if the mass of the material 16 is estimated to be small, the inertia of the material 16 is estimated to be small, and the electric motor (one of the X motor and the Y motor) is controlled such that the electric motor can be driven with larger acceleration and deceleration. If the mass of the material 16 is estimated to be large, the inertia of the material 16 is estimated to be large, and the electric motor (one of the X motor and the Y motor) is controlled such that the electric motor can be driven with smaller acceleration and deceleration. Based on the above control method, the embroidery sewing machine can sew more rapidly and accurately.

Figure 9:
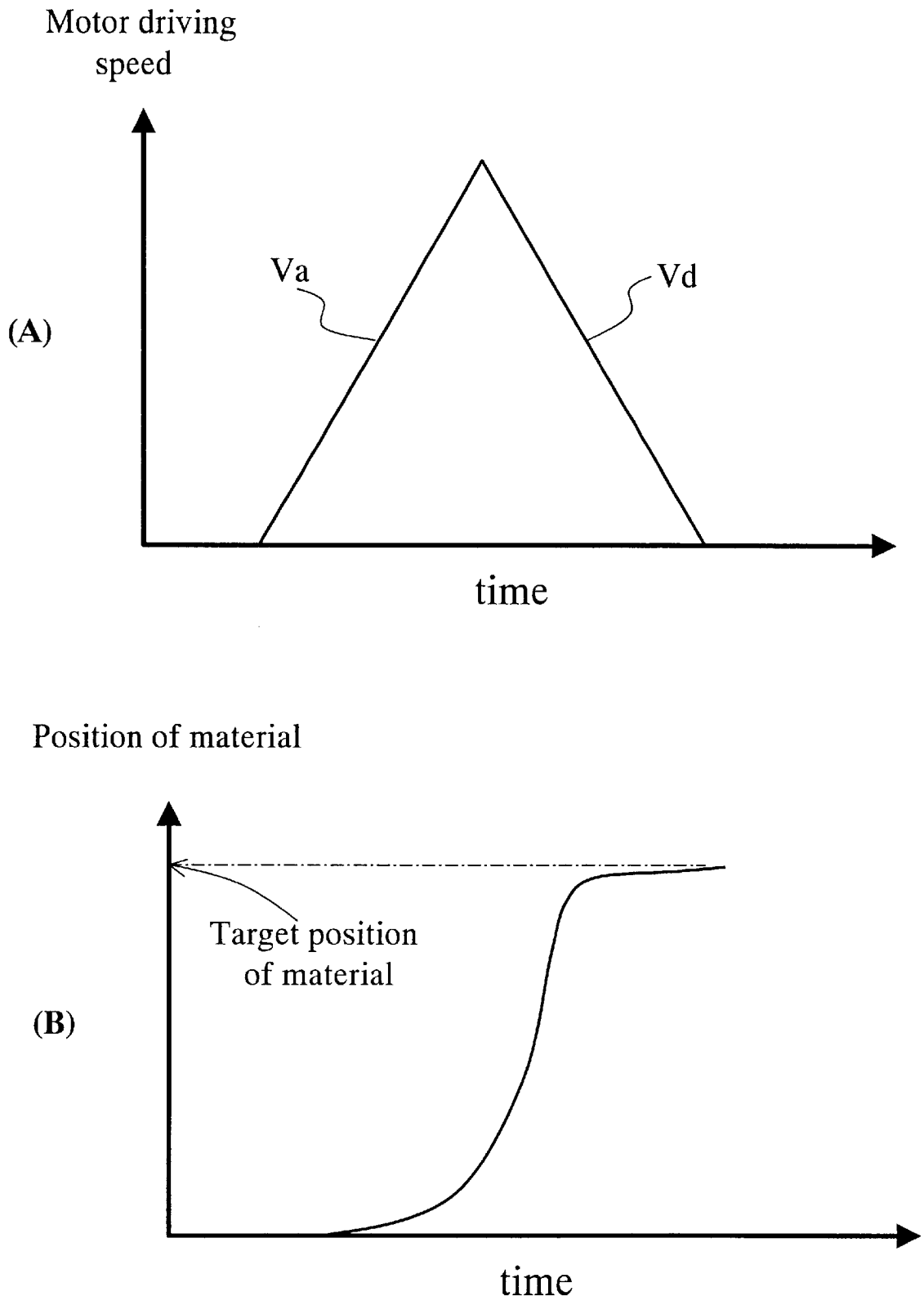
FIG. 9(A) shows a graph representing the measured rotation velocity of the electric motor of the embodiment actually moving the material having the small mass.
FIG. 9(B) shows a graph representing the measured rotation amount of the electric motor of the embodiment actually moving the material having the small mass.
Figure 10:
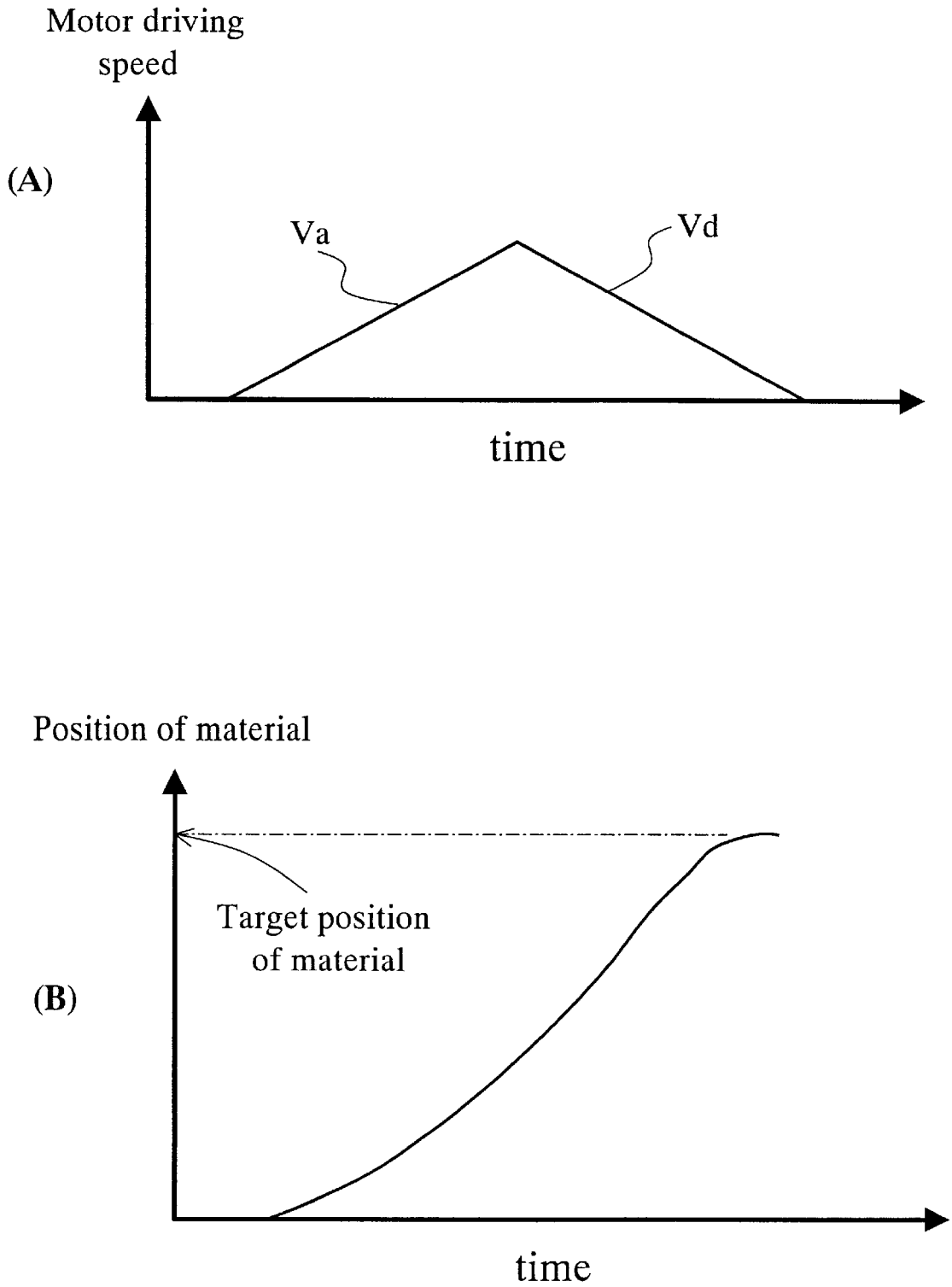
FIG. 10(A) shows a graph representing the measured rotation velocity of the electric motor actually moving the material having the large mass.
FIG. 10(B) shows a graph representing the measured rotation amount of the electric motor actually moving the material having the large mass.

When the mass of the material 16 is estimated to be small, then the material 16 is rapidly moved to a targeted point by driving the electric motor with increased acceleration Va and deceleration Vd as shown in FIGS. 9(A) and (B). When the mass of the material 16 is estimated to be large, then the material 16 is slowly moved to the targeted point by driving the electric motor with decreased acceleration Va and deceleration Vd as shown in FIGS. 10(A) and (B).

Figure 11:
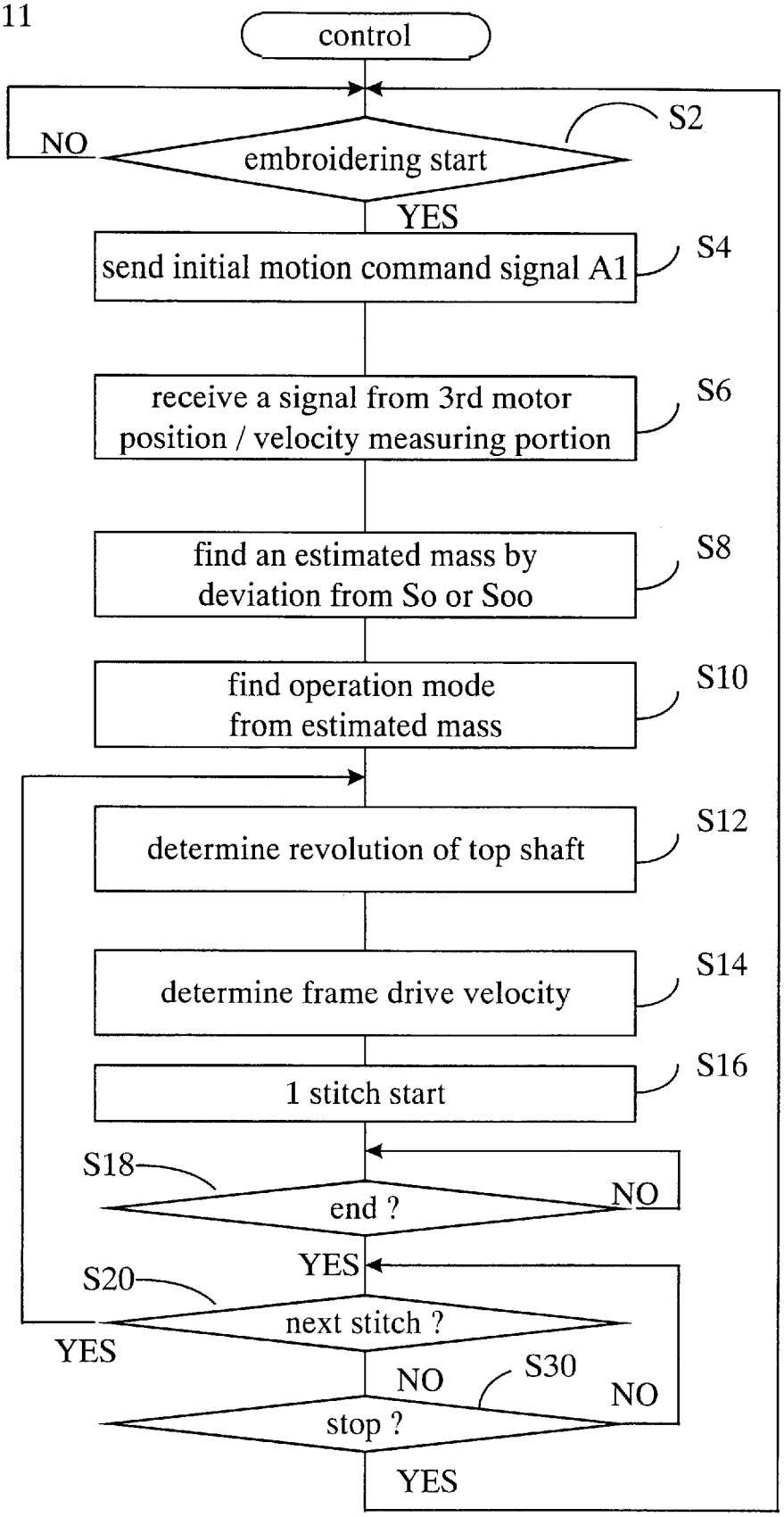
FIG. 11 shows a main flow chart diagram for a controller processing of the embroidery sewing machine of the embodiment.

FIG. 11 shows a flow chart diagram of a control process executed by the main CPU of the embroidering command operator 22. The embroidering command operator 22 determines whether the needle bar 11 is located at the upper dead point side or not, and determines whether to start the embroidering operation or not in Step. 2 in FIG. 11. If the embroidering command operator 22 can start the embroidering operation, the embroidering command operator 22 passes to Step. 4, and then the initial motion command signal A1 (in FIG. 3(A)) is sent to the X motor 18 via the X driver circuit 42. Thus, the material 16 is initially moved in the X-axis direction. Even the frame holder 17 holding the material 16 can be initially moved in Step. 4. The embroidering command operator 22 passes to Step. 6 and receives the measurement signal Mx thereby passing to Step. 8. The embroidering command operator 22 measures the measured motor position Sm and calculates the mass of the material. The embroidering command operator 22 further calculates the deviation ΔSa. The deviation ΔSa is the difference between the measured motor position Sm and the standard motor position S0 previously stored in the memory 22 m. Thus, the embroidering command operator 22 finds the estimated mass of the material 16 by a calculation based on the predetermined formula depending on the deviation ΔSa in Step. 8. The embroidering command operator 22 send signals for determining the control mode corresponding to the mass of the material 16 to the motors 18 and 19. The embroidering command operator 22 determines the rotation amount of the top shaft motor 14 corresponding to the above control mode in Step. 12. The embroidering command operator 22 determines both the moving distance per unit of time of the X motor 18 and the moving distance per unit time of the Y motor 19 suitable to the mass of the material 16 in Step. 14. Thus, conditions for moving the material 16 and for driving the top shaft 12, which are adjustable to the variety of the mass of the material 16, are determined in Step. 14. The embroidering command operator 22 starts a one stitch embroidering in Step. 16. The embroidering command operator 22 determines whether the one stitch embroidering is finished or not in Step. 18. If the one stitch embroidering is finished, then the embroidering command operator 22 determines whether to allow a next one stitch embroidering to start or not in Step. 20. If the next one stitch embroidering is allowed to start, the embroidering command operator 22 returns to Step. 12. If not, the embroidering command operator 22 determines whether to stop the next one stitch embroidering or not in Step. 30. If the next one stitch embroidering is stopped, the embroidering command operator 22 returns to Step. 2.

The triangular pulse as shown in FIG. 3(A) is used as the initial motion command signal A1 for initially moving the material 16 in this embodiment. However, even the rectangular pulse as shown in FIG. 3(B) instead of the above triangular pulse can be used as the initial travel command signal A2 for driving the X motor 18. In FIG. 3(B), the horizontal axis represents time, the vertical axis represents an electric voltage or current charged to the X motor 18. The initial travel command signal A2 comprises a first pulse which rapidly increases depending on time and which has a stepped shape and a second pulse which rapidly falls. FIG. 4(B) shows a characteristic pulse C2 and a standard characteristic pulse B2. The characteristic pulse C2 is the pulse output by the X motor when the mass of the material 16, which is not equal to the standard mass, is moved by the X motor 18 upon receiving the initial motion command signal A2. The standard characteristic pulse B2 is the pulse output by the X motor when the mass of the material 16, which is equal to the standard mass is moved by the X motor 18 upon receiving the initial motion command signal A2. As shown in FIG. 4(B), the characteristic pulse C2 differs from the standard characteristic pulse B2.

In this embodiment, prior to embroidering, the mass of the material 16 is estimated. It is also allowable to estimate the mass of the material 16 during the initial stage of the embroidering operation. The material 16 weight is automatically estimated by estimating the mass of the material 16. Only if the material mass estimation is executed in a short period of time, the material mass estimation during the initial stage of the embroidering operation slightly affects an accuracy of the whole embroidering process.

In this embodiment, the material mass estimation is executed by driving the X motor 18 so as to initially move the material 16 in the X-axis direction. It is also allowable for the material mass estimation to be executed by driving the Y motor 19 so as to initially move the material 16 in the Y-axis direction. It is even allowable for the material mass estimation to be executed by driving both the X motor 18 and the Y motor 19. The estimated material of this invention includes the embroidering frame mass. However, if the embroidering frame mass is precisely known, then it is allowable to estimate only the mass of the material 16 not including the embroidering frame mass. The material mass estimation is applied only to the embroidery sewing machine in this embodiment. However, the material mass estimation can be applied to any type of sewing machine in general use for improving its sewing accuracy.

The invention has thus been shown and described with reference to a specific embodiment: However, it should be understood that the invention is in no way limited to the details of the illustrated structures but changes and modifications may be made without departing from the spirit and scope of the appended claims.

What is claimed is:

1. A sewing machine comprising:

a movable holder portion holding a material to be sewn;

a holder drive portion moving the holder portion during sewing of the material;

a needle drive portion driving a sewing needle to sew; and a controller regulating the holder drive portion and the needle drive portion, the controller including a) an initial motion means for moving the material to be sewn based upon one of before sewing and during an initial stage of sewing, and b) an estimating means for estimating a mass of the material to be sewn based on a physical value, the physical value being based upon one of a moving speed of the material for a predetermined period of time and a moving distance of the material for the predetermined period of time.

2. A sewing machine according to claim 1, wherein said controller further comprising an estimated mass adaptive control means for automatically adjusting a control mode based on the estimated mass of the material by the estimating means.

3. A sewing machine according to claim 1, wherein the physical value is determined by one of a driving speed of an initial movement of the movable holder portion holding the material and a driving distance of the holder drive portion for the predetermined period of time.

4. A sewing machine according to claim 2, wherein the physical value is determined by one of a driving speed of an initial movement of the movable holder portion holding the material and a driving distance of the holder drive portion for the predetermined period of time.

5. A sewing machine according to claim 1, wherein said holder drive portion moves the holder portion in one of an X-axis direction, a Y-axis direction and both an X-axis and Y-axis directions.

6. A sewing machine according to claim 5, further comprising an X-axis motor for moving the holder portion in the X-axis direction and a Y-axis motor for moving the holder portion in the Y-axis direction.

7. A sewing machine according to claim 6, further comprising a motor velocity detecting means for measuring a motor velocity.

8. A sewing machine according to claim 7, further comprising a disturbance observer for estimating a disturbance of at least one of the motors based upon the detected velocity and an initial motion command signal.

9. A sewing machine according to claim 8, further comprising a digital filter for selecting a disturbance signal, wherein the estimating means estimates the mass of the material based upon the selected disturbance signal.

10. A sewing machine according to claim 6, where in the motors output a characteristic pulse when the material is moved by an initial motion command signal input to at least one of the motors, wherein the characteristic pulse indicates the mass of the material.

11. A sewing machine according to claim 6, wherein a driving distance of the motor is measured within a predetermined period of time.

12. A sewing machine according to claim 11, wherein the measured driving distance and a standard driving distance are compared in order to estimate the mass of the material.

13. A sewing machine according to claim 6, wherein a rotation velocity of at least one of the motors is detected and compared with a standard rotation velocity in order to estimate the mass of the material.

14. A sewing machine according to claim 1, wherein an initial motion command signal is input to the controller for initially moving the material.

15. A sewing machine according to claim 14, wherein the initial motion command signal is a triangular pulse.

16. A sewing machine according to claim 14, wherein the initial motion command signal is a rectangular pulse.

17. A method of estimating a mass of a material to be sewn by a sewing machine, comprising the steps of:

determining if a sewing operation is ready to start;

inputting an initial motion command signal to initially move the material based on one of a) before actual sewing operation and b) during an initial stage of the sewing operation;

receiving one of a position signal and a velocity signal based upon the movement of the material; and estimating the mass of the material based upon the received signal.

18. A method according to claim 17, wherein the estimating step further comprises the step of calculating a deviation between a measured motor position and a standard motor position in order to estimate the mass of the material.

19. A method according to claim 17, wherein the estimating step further comprises the step of determining rotational amount/moving distance per unit of time.

20. A method according to claim 17, further comprising the step of determining an operation mode of the sewing machine from the estimated mass of the material.

* * * * *